US007043771B1

(12) United States Patent
Alessi

(10) Patent No.: US 7,043,771 B1
(45) Date of Patent: May 16, 2006

(54) UNDERWEAR HAVING AN OFFSET FLAP OPENING WITH ALIGNMENT GUIDE

(76) Inventor: Brian J. Alessi, P.O. Box 12262, Columbia, SC (US) 29211

( * ) Notice: Subject to any disclaimer, the term of this patent is extended or adjusted under 35 U.S.C. 154(b) by 260 days.

(21) Appl. No.: 10/272,561

(22) Filed: Oct. 16, 2002

Related U.S. Application Data

(60) Provisional application No. 60/400,527, filed on Aug. 1, 2002.

(51) Int. Cl.
*A41B 9/02* (2006.01)

(52) U.S. Cl. ..... 2/403; 2/405

(58) Field of Classification Search ..... 2/400, 2/403, 405, 228, 238, 227; 604/385.01–396
See application file for complete search history.

(56) References Cited

U.S. PATENT DOCUMENTS

| | | | | |
|---|---|---|---|---|
| 1,842,472 | A * | 1/1932 | Firsching, Jr. | 602/67 |
| 3,714,946 | A | 2/1973 | Rudes | |
| 4,555,245 | A | 11/1985 | Armbruster | |
| 4,644,945 | A | 2/1987 | Thorner | |
| 4,668,229 | A | 5/1987 | Fago et al. | |
| 4,863,448 | A | 9/1989 | Berg | |
| 5,087,253 | A * | 2/1992 | Cooper | 604/385.1 |
| 5,291,617 | A | 3/1994 | Moretz et al. | |
| 5,435,014 | A | 7/1995 | Moretz et al. | |
| 5,499,404 | A * | 3/1996 | Marchiorello | 2/403 |
| 5,669,902 | A | 9/1997 | Sivilich | |
| D387,538 | S * | 12/1997 | Taylor et al. | D2/716 |
| D417,940 | S | 12/1999 | Coates et al. | |
| 6,013,066 | A | 1/2000 | Samuelsson | |
| 6,014,777 | A * | 1/2000 | Gupton | 2/400 |
| 6,138,282 | A * | 10/2000 | Follese | 2/400 |
| 6,145,132 | A | 11/2000 | Towner | |

OTHER PUBLICATIONS

Internet website located at www.freshpair.com/catalog_section_men_idl7.html >.
Internet website located at www.webundies.com/new.htm.
Internet website located at www.drleonards.com.
Internet website located at www.joeboxer.com/boxer_holdings.html.

* cited by examiner

*Primary Examiner*—Gloria M. Hale
(74) *Attorney, Agent, or Firm*—Nelson Mullins Riley & Scarborough LLP

(57) ABSTRACT

Underwear having a midriff encircling portion, which is bounded at the time with an elastic waistband. At the crotch area, the midriff portion is divided into a left leg member and a right leg member. A vertically-extending central axis is defined between the crotch area and the waistband, in alignment with the user's umbilicus (belly button). The front portion of the underwear contains a flap opening which is offset from the central axis. A vertical guide line extends along the central axis to aid the user in properly maintaining the offset positioning of the flap opening. The front portion of the underwear may also have a multi-layer panel to absorb post-urination drainage.

16 Claims, 4 Drawing Sheets

UNDERWEAR HAVING AN OFFSET FLAP OPENING WITH ALIGNMENT GUIDE

PRIORITY CLAIM

The present invention claims priority to U.S. Provisional Application No. 60/400,527, filed Aug. 1, 2002, which is hereby incorporated by reference.

BACKGROUND OF THE INVENTION

The present invention generally relates to men's underwear. More particularly the invention relates to underwear with an offset flap opening and alignment guide.

There are primarily two types of men's underwear, briefs and boxer shorts. While briefs fit tightly and are generally only available in unadorned white cotton, boxer shorts fit loosely and are available in a wide variety of colors and patterns. Due to the loose fit and style, many men prefer boxer shorts.

A drawback of boxer shorts, however, is the low absorption of liquids. Even in healthy males (and not referring to persons suffering from incontinence), a small amount of urine remains temporarily in the urethra after urination. A portion of this urine may drain from the urethra into the underwear. With boxer shorts, this drainage tends to reach the outer surface of the user's pants by capillary action, thereby causing embarrassment.

Another shortcoming of boxer shorts is the central positioning of the flap opening. During even normal activities, the flap opening tends to gap, thereby creating an opening through which the user's penis may protrude. This causes discomfort for the user and exacerbates the post-urination drainage problem mentioned above, which also embarrasses the user.

SUMMARY OF THE INVENTION

The present invention recognizes and addresses various drawbacks of prior art constructions and methods. Accordingly, it is an object of the present invention to provide an improved men's underwear that prevents accidental protrusion of the user's penis through the flap opening, as well as controlling post-urination drainage.

The present invention provides underwear having a midriff encircling portion, which is bounded at the top with an elastic waistband. At the crotch area, the midriff portion is divided into a left leg member and a right leg member. A vertically-extending central axis is defined between the crotch area and the waistband, in alignment with the user's umbilicus (belly button). The front portion of the underwear contains a flap opening which is offset from the central axis. A vertical guide line extends along the central axis to aid the user in properly maintaining the offset positioning of the flap opening. The front portion of the underwear may also have a multi-layer panel to absorb post-urination drainage.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
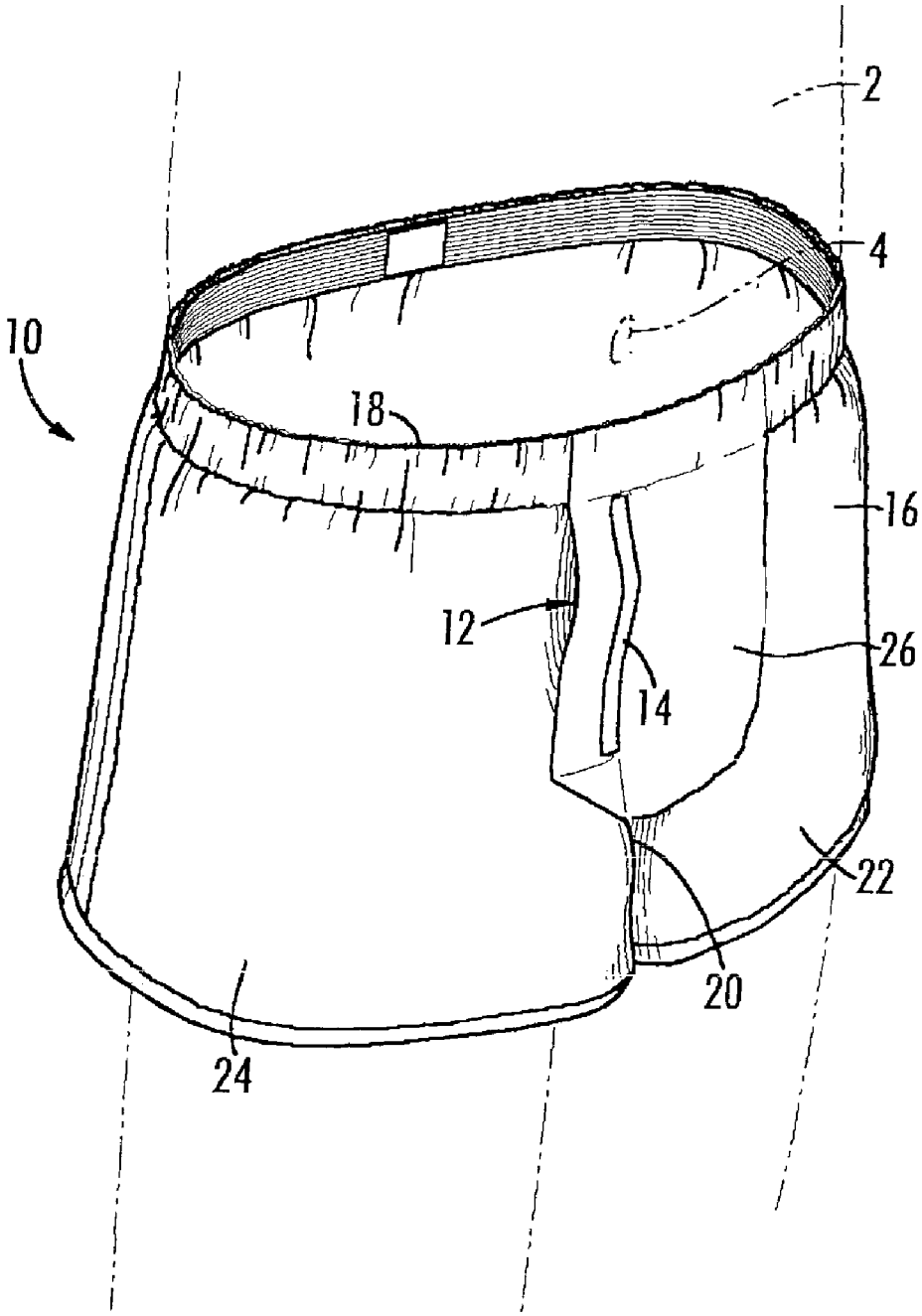
FIG. 1 is a perspective view of a person wearing the underwear according to an embodiment of the present invention.

Repeat use of reference characters in the present specification and drawings is intended to represent same or analogous features or elements of the invention.

DETAILED DESCRIPTION OF PREFERRED EMBODIMENTS

Reference is made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can by made in the present invention without departing from the scope or spirit thereof. For example, features illustrated or described as part of one embodiment may be used on another embodiment to yield a still further embodiment.

The present invention provides underwear 10 having an offset flap opening 12 with a guide line 14. By way of example, the present invention is discussed in terms of loose-fitting underwear, such as boxer shorts. It should be understood by one of ordinary skill in the art, however, that elements of the present invention may be adapted in briefs, boxer briefs and the like.

Figure 2:
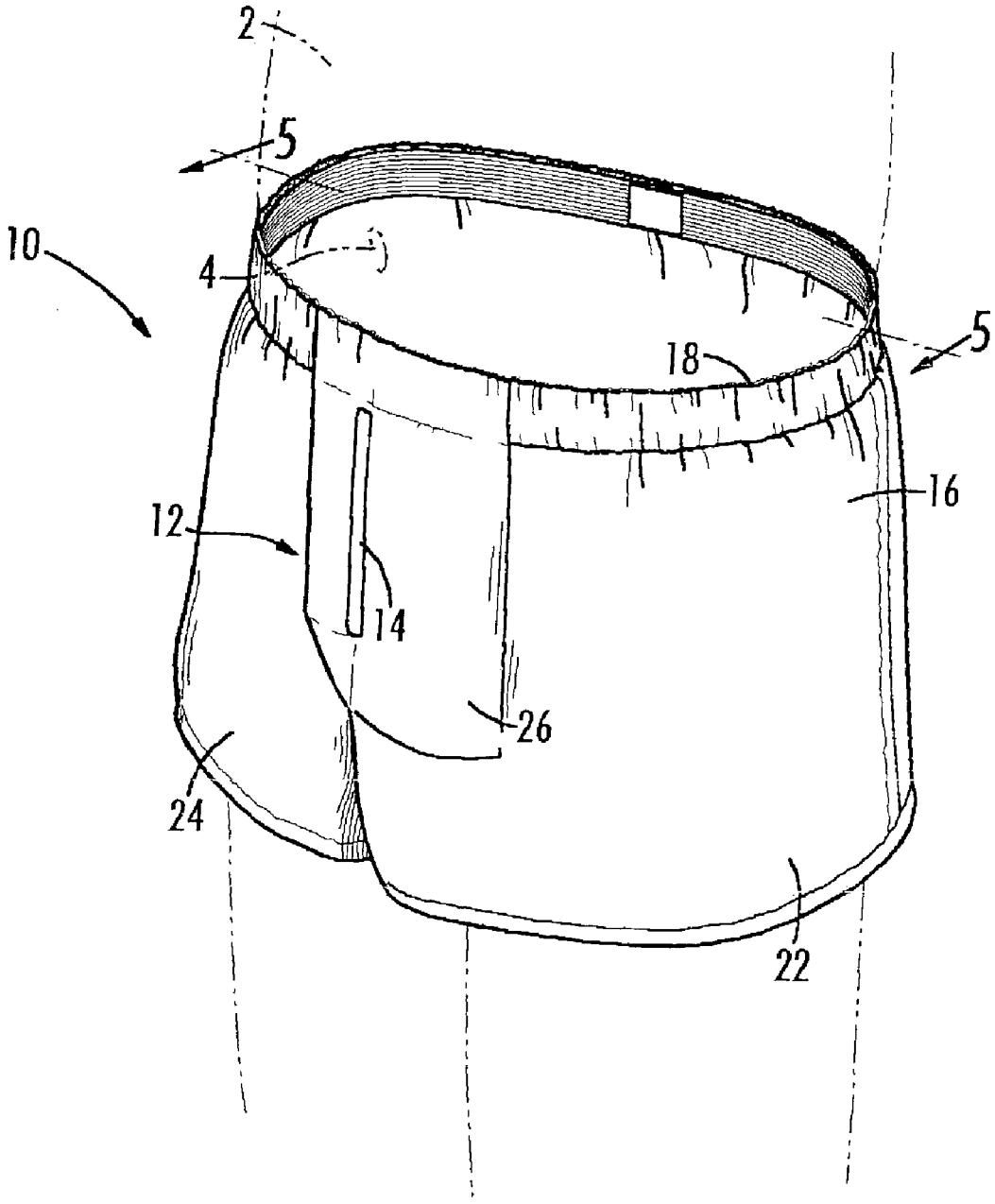
FIG. 2 is a detailed perspective view of a person wearing the underwear of FIG. 1.

FIGS. 1 and 2 show a user wearing underwear 10 on his body 2. Underwear 10 has a midriff encircling portion 16 that is bounded along its top with an attached elastic waistband 18. At the crotch area 20, midriff portion 16 is divided into a left leg member 22 and a right leg member 24. A line extending substantially vertically between the crotch area 20 and waistband 18 defines a central axis. The central axis intersects waistband 18 approximately in the area near the user's umbilicus 4 (belly button).

Underwear 10 has a flap opening 12 for removal of the user's penis (not shown) from underwear 10 during urination. Flap opening 12 is offset from central axis to prevent the user's penis from accidentally protruding through flap opening 12 during normal activity. While flap opening 12 is shown for access of a user's right hand, it should be appreciated that flap opening 12 could be reversed about the central axis for access by a user's left hand. The exact distance that flap opening 12 is offset differs, depending upon the size of underwear 10. One of ordinary skill in the art should understand that the offset distance should be sufficient to prevent accidental protrusion of the user's penis through flap opening 12. It should also be appreciated the inner edge of flap opening could also be offset from the central axis to increase the durability of underwear 10.

Figure 3A:
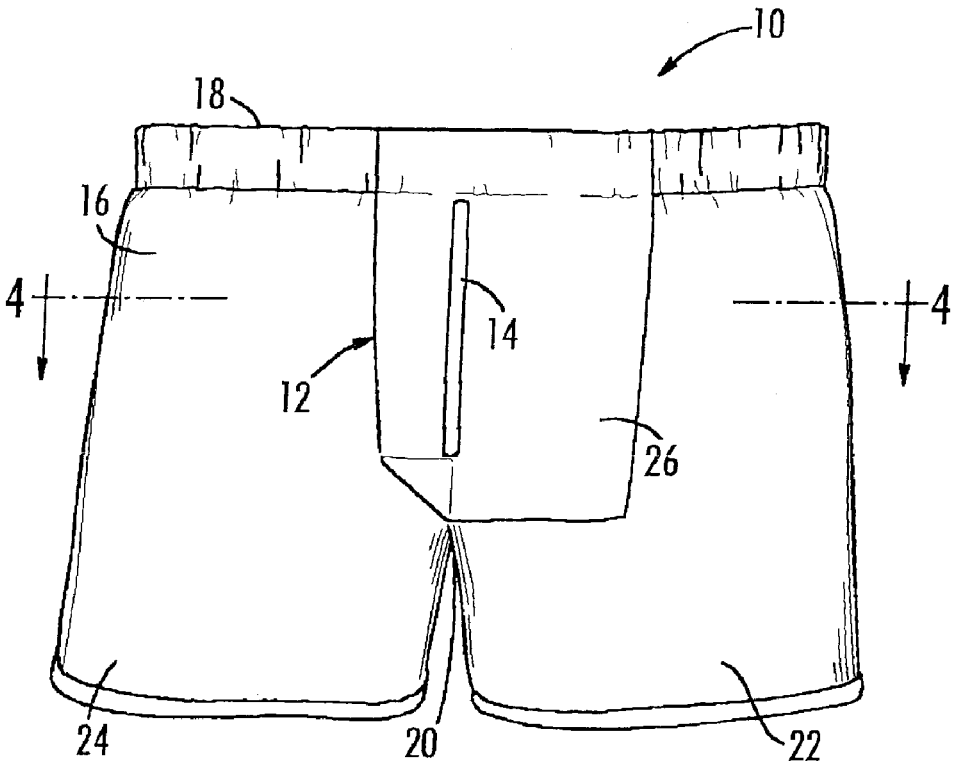
FIG. 3A is a front view of the underwear of FIG. 1 with a first guide line design.
Figure 3B:
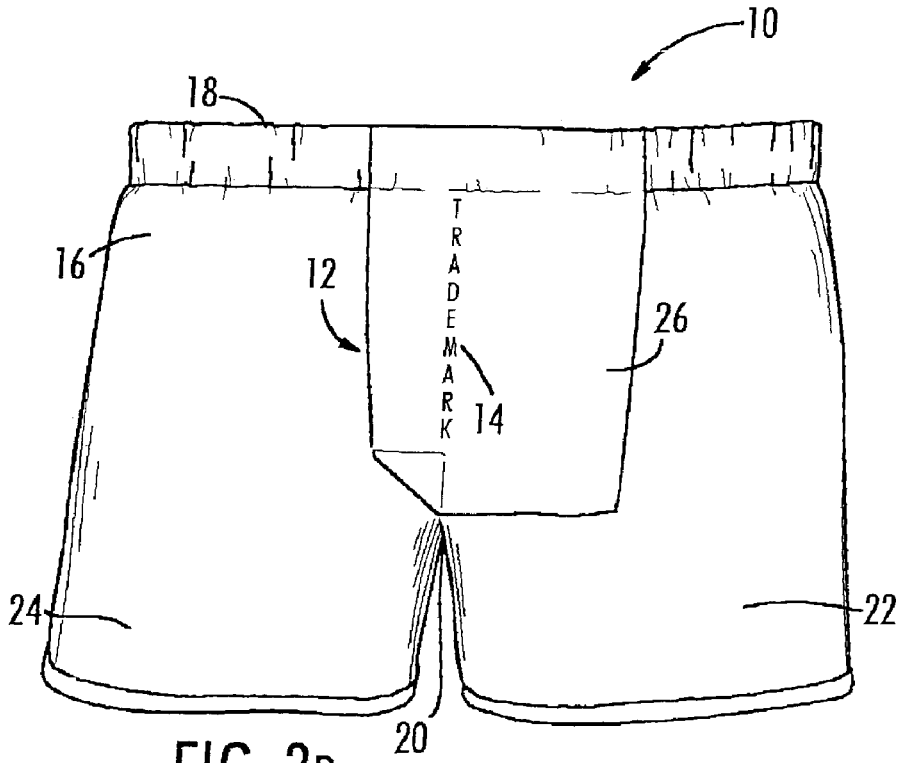
FIG. 3B is a front view of the underwear of FIG. 1 with a second guide line design.
Figure 4:
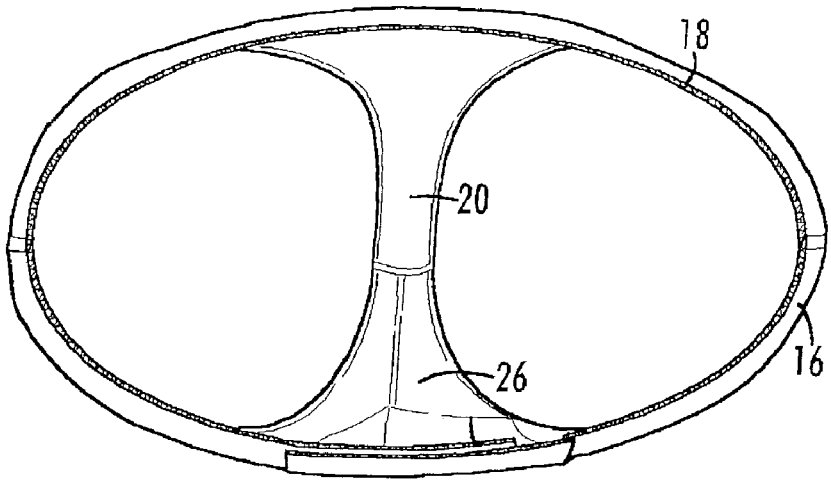
FIG. 4 is a cross sectional view of the underwear of FIG. 3A along line 4—4.
Figure 5:
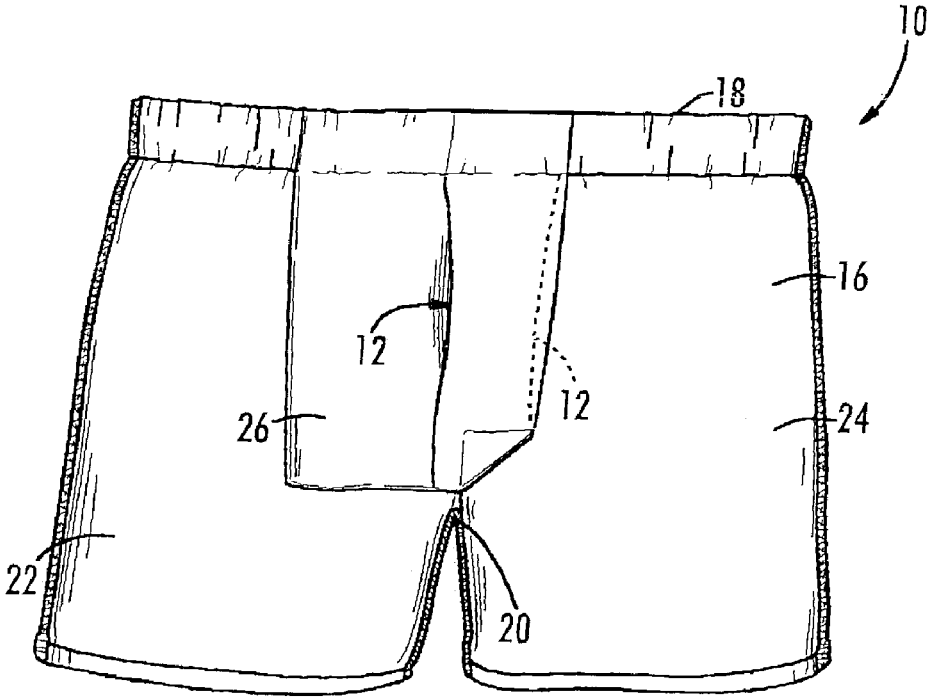
FIG. 5 is a cross sectional view of the underwear of FIG. 2 along line 5—5.

In order to properly maintain the offset positioning of flap opening 12, underwear 10 has a guide line 14 as best seen in FIGS. 3A and 3B. Guide line 14 extends vertically between crotch area 20 and waistband 18. Guide line 14 should be aligned with the central axis to maintain the proper offset of flap opening 12. Guide line 14 may also be aligned with the user's umbilicus 4 (belly button). Instead of using a line as shown in FIG. 3A, guide line 14 may be formed by letters (such as a word), numerals, symbols and the like. For example, the user's name or a trademark could be used to form guide line 14 as seen in FIG. 3B.

In order to control the problems of post-urination drainage, front portion of underwear 10 has a panel 26 with multiple layers of fabric to absorb post-urination drainage. While many different types of fabric could be used to form panel 26, preferably the same type of fabric is used for the entire underwear 10, including panel 26. Since the penis generally hangs to the left of the central axis, panel 26 is positioned substantially left of the central axis. As the user's penis comes into contact with panel 26, any post-urination drainage is absorbed by panel 26.

In operation, the user will put on underwear 10 and position guide line 14 in alignment with the central axis. With guide line 14 positioned along central axis, flap opening 12 is offset from central axis to prevent accidental protrusion of the user's penis through flap opening 12. After urinating, panel 26 will absorb any post-urination drainage which occurs.

It can thus be seen that the present invention provides an underwear having novel properties. While preferred embodiments of the invention have been shown and described, modifications and variations may be made thereto by those of ordinary skill in the art without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to be limitative of the invention.

What is claimed is:

1. Loosely fitting underwear for a male, said underwear comprising:

a piece of material formed to define a midriff encircling portion having an upper opening for receiving a torso and two bottom openings for receiving legs, said midriff encircling portion having a front surface and a back surface, a central axis defined along a vertical axis and being aligned with the wearer's belly button;

a guide line extending along said central axis and being formed on said front surface of said piece of material;

an elastic band bound along the top of said midriff encircling portion; and a flap opening in said front surface of said piece of material allowing the wearer to urinate by inserting his penis therethrough, said flap opening being horizontally offset from said central axis to prevent the wearer's penis from accidentally protruding through said flap opening.

2. The claim as recited in claim 1, wherein said flap opening is horizontally offset to the wearer's right of said central axis.

3. The claim as recited in claim 1, wherein said guide line is formed from a plurality of symbols.

4. The claim as recited in claim 1, wherein said guide line is formed from a word.

5. The claim as recited in claim 1, wherein said guide line is formed from a linear trademark.

6. The claim as recited in claim 1, wherein said front surface contains a panel having multiple layers of materials sufficient to absorb post-urination drainage.

7. The claim as recited in claim 6, wherein said panel is formed horizontally offset from said central axis.

8. The claim as recited in claim 6, wherein said panel is formed horizontally offset to the wearer's left of said central axis.

9. The claim as recited in claim 6, wherein said panel is formed from the same type of material as said piece of material.

10. Loosely fitting underwear for a male comprising:

a piece of material formed to define a midriff encircling portion having an upper opening for receiving a torso and two bottom openings for receiving legs, said midriff encircling portion having a front surface and a back surface, a central axis defined along a vertical axis and being aligned with the wearer's belly button;

a flap opening in said front surface of said material allowing the wearer to urinate by inserting his penis therethrough;

an elastic band bound along the top of said midriff encircling portion; and a guide line extending along said central axis and being formed on said front surface of said piece of material.

11. The claim as recited in claim 10, wherein said guide line is formed from a plurality of symbols.

12. The claim as recited in claim 10, wherein said guide line is formed from a word.

13. The claim as recited in claim 10, wherein said guide line is formed from a linear trademark.

14. Loosely fitting underwear for a male comprising:

a piece of material formed to define a midriff encircling portion having an upper opening for receiving a torso and two bottom openings for receiving legs, said midriff encircling portion having a front surface and a back surface, a central axis defined along a vertical axis and being aligned with the wearer's belly button;

a flap opening in said front surface of said material allowing the wearer to urinate by inserting his penis therethrough;

a guide line extending along said central axis and being formed on said front surface of said piece of material;

an elastic band bound along the top of said midriff encircling portion; and a panel with multiple layers of fabric sufficient to absorb post-urination drainage formed on said front surface of said piece of material.

15. The claim as recited in claim 14, wherein said flap opening is horizontally offset from said central axis.

16. The claim as recited in claim 14, wherein said panel is formed horizontally offset to the wearer's left of said central axis.

* * * * *